US007986888B2

(12) United States Patent
Hibino

(10) Patent No.: US 7,986,888 B2
(45) Date of Patent: Jul. 26, 2011

(54) IMAGE PROCESSOR HAVING A JUDGING UNIT

(75) Inventor: Masaaki Hibino, Mie (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 473 days.

(21) Appl. No.: 12/058,277

(22) Filed: Mar. 28, 2008

(65) Prior Publication Data

US 2008/0240745 A1 Oct. 2, 2008

(30) Foreign Application Priority Data

Mar. 30, 2007 (JP) ..... 2007-092787

(51) Int. Cl.
*G03G 15/00* (2006.01)

(52) U.S. Cl. ..... 399/12

(58) Field of Classification Search ..... 399/12, 399/13

See application file for complete search history.

(56) References Cited

U.S. PATENT DOCUMENTS 5,930,553 A * 7/1999 Hirst et al. ..... 399/8
2005/0180764 A1* 8/2005 Koike ..... 399/12
2005/0219284 A1* 10/2005 Shima ..... 347/7
2006/0216046 A1* 9/2006 Hatakeyama ..... 399/27
2007/0067133 A1* 3/2007 Abe et al. ..... 702/127
2007/0297814 A1* 12/2007 Kasai ..... 399/12

FOREIGN PATENT DOCUMENTS

JP 2006267528 A 10/2006

* cited by examiner

*Primary Examiner* — David M Gray
*Assistant Examiner* — Rodney Bonnette
(74) *Attorney, Agent, or Firm* — Baker Botts L.L.P.

(57) ABSTRACT

An image processor includes a main body and a consumable product which is replaceably installed to the main body is provided with a storage configured to store a table to which a record indicative of a usage status of the consumable product is to be successively added, an installation detection unit configured to detect that the consumable product is newly installed, a judging unit configured to judge whether the newly installed consumable product has been used in the main body continuously or discontinuously when the detection unit detects that the consumable product is newly installed. A usage status detection unit detects the usage status of the consumable product. A controller updates the latest record of the table if the consumable product has been continuously used, while creates a new record to be added to the table if the consumable product has been used discontinuously.

7 Claims, 11 Drawing Sheets

Fig.3A

| ID | Life | Name | Updated | Device ID |
|---|---|---|---|---|
| FU10098765 | 100% | FU-180 | | |

Fig.3B

| ID | Life | Name | Updated | Device ID |
|---|---|---|---|---|
| FU10098765 | 83% | FU-180 | 2006/10/1 | MFC10010001 |

Fig.4A

| ID | Life | Name | Updated | Device ID |
|---|---|---|---|---|
| PU10011111 | 100% | PU-500 | | |

Fig.4B

| ID | Life | Name | Updated | Device ID |
|---|---|---|---|---|
| PU10011111 | 75% | PU-500 | 2006/10/1 | MFC10010001 |

Fig.5A

| ID | Life | Name | Updated | Device ID |
|---|---|---|---|---|
| TN10012345 | 100% | TN-550 | | |

Fig.5B

| ID | Life | Name | Updated | Device ID |
|---|---|---|---|---|
| TN10012345 | 100% | TN-550 | | MFC10010001 |

Fig.5C

| ID | Life | Name | Updated | Device ID |
|---|---|---|---|---|
| TN10012345 | 1% | TN-550 | 2006/10/1 | MFC10010001 |

Fig.5D

| ID | Life | Name | Updated | Device ID |
|---|---|---|---|---|
| TN10012349 | 80% | TN-550 | 2006/10/1 | MFC10010002 |

Fig.5E

| ID | Life | Name | Updated | Device ID |
|---|---|---|---|---|
| TN10012349 | 80% | TN-550 | 2006/10/1 | MFC10010001 |

Fig.5F

| ID | Life | Name | Updated | Device ID |
|---|---|---|---|---|
| TN10012349 | 70% | TN-550 | 2007/2/1 | MFC10010001 |

Fig.5G

| ID | Life | Name | Updated | Device ID |
|---|---|---|---|---|
| TN10012349 | 50% | TN-550 | 2007/2/3 | MFC10010001 |

Fig.6A

| | F1 | F2 | F3 | F4 | F5 | F6 |
|---|---|---|---|---|---|---|
| | ID | Initial Life | Current Life | Option | | |
| | | | | Print Pages | Registered | Updated |
| R1 | FU10098765 | 100% | 100% | 0 | 2005/1/1 | |
| R2 | PU10011111 | 100% | 100% | 0 | 2005/1/1 | |
| R3 | TN10012345 | 100% | 100% | 0 | 2005/1/1 | |
| | | | | | | |
| | | | | | | |

Fig.6B

| | ID | Initial Life | Current Life | Option | | |
|---|---|---|---|---|---|---|
| | | | | Print Pages | Registered | Updated |
| R1 | FU10098765 | 100% | 83% | 10000 | 2005/1/1 | 2006/10/1 |
| R2 | PU10011111 | 100% | 75% | 10000 | 2005/1/1 | 2006/10/1 |
| R3 | TN10012345 | 100% | 1% | 10000 | 2005/1/1 | 2006/10/1 |
| | | | | | | |
| | | | | | | |

Fig.6C

| | ID | Initial Life | Current Life | Option | | |
|---|---|---|---|---|---|---|
| | | | | Print Pages | Registered | Updated |
| R1 | FU10098765 | 100% | 83% | 10000 | 2005/1/1 | 2006/10/1 |
| R2 | PU10011111 | 100% | 75% | 10000 | 2005/1/1 | 2006/10/1 |
| R3 | TN10012345 | 100% | 1% | 10000 | 2005/1/1 | 2006/10/1 |
| R4 | TN10012349 | 80% | 80% | 0 | 2006/10/1 | 2006/10/1 |
| | | | | | | |

Fig.6D

| | ID | Initial Life | Current Life | Option | | |
|---|---|---|---|---|---|---|
| | | | | Print Pages | Registered | Updated |
| R1 | FU10098765 | 100% | 80% | 12000 | 2005/1/1 | 2007/2/1 |
| R2 | PU10011111 | 100% | 70% | 12000 | 2005/1/1 | 2007/2/1 |
| R3 | TN10012345 | 100% | 1% | 10000 | 2005/1/1 | 2006/10/1 |
| R4 | TN10012349 | 80% | 70% | 2000 | 2006/10/1 | 2007/2/1 |
| | | | | | | |

Fig.7A

| | F1 | F2 | F3 | F4 | F5 | F6 |
|---|---|---|---|---|---|---|
| | ID | Initial Life | Current Life | Option | | |
| | | | | Print Pages | Registered | Updated |
| R1 | FU10098765 | 100% | 80% | 12000 | 2005/1/1 | 2007/2/1 |
| R2 | PU10011111 | 100% | 70% | 12000 | 2005/1/1 | 2007/2/1 |
| R3 | TN10012345 | 100% | 1% | 10000 | 2005/1/1 | 2006/10/1 |
| R4 | TN10012349 | 80% | 70% | 2000 | 2006/10/1 | 2007/2/1 |
| R5 | TN10012349 | 50% | 50% | 0 | 2007/2/3 | 2007/2/3 |

Fig.7B

| | ID | Initial Life | Current Life | Option | | |
|---|---|---|---|---|---|---|
| | | | | Print Pages | Registered | Updated |
| R1 | FU10098765 | 100% | 77% | 14000 | 2005/1/1 | 2007/6/1 |
| R2 | PU10011111 | 100% | 65% | 14000 | 2005/1/1 | 2007/6/1 |
| R3 | TN10012345 | 100% | 1% | 10000 | 2005/1/1 | 2006/10/1 |
| R4 | TN10012349 | 80% | 70% | 2000 | 2006/10/1 | 2007/2/1 |
| R5 | TN10012349 | 50% | 40% | 2000 | 2007/2/3 | 2007/6/1 |

Fig.11

| | ID | Initial Life | Current Life | Option | | |
|---|---|---|---|---|---|---|
| | | | | Print Pages | Registered | Updated |
| R1 | FU10098765 | 100% | 80% | 12000 | 2005/1/1 | 2007/2/1 |
| R2 | PU10011111 | 100% | 70% | 12000 | 2005/1/1 | 2007/2/1 |
| R3 | TN10012345 | 100% | 95% | 0 | 2005/1/1 | 2005/1/1 |
| R4 | TN10012345 | 95% | 1% | 10000 | 2005/1/1 | 2006/10/1 |
| R5 | TN10012349 | 80% | 70% | 2000 | 2006/10/1 | 2007/2/1 |

IMAGE PROCESSOR HAVING A JUDGING UNIT

CROSS-REFERENCE TO RELATED APPLICATION

The present application claims priority from Japanese Patent Application No. 2007-092787, filed on Mar. 30, 2007, the disclosure of which is incorporated herein by reference in its entirety.

BACKGROUND

1. Field of the Invention

The following descriptions relate to an image processor including a consumable product and a main body that the consumable product is attachable thereto and detachable therefrom.

2. Description of Related Art

Image processors are known to include a toner cartridge configured to store toner therein and a main body to which the toner cartridge is detachably attachable. In such an image processor, a controller provided in the main body of the image processor may determine an amount of toner consumed based on the number of sheets that have been printed.

The toner cartridge is configured to be attachable to and detachable from the main body of the image processor. Thus, the toner cartridge currently-used in the image processor may be removed therefrom and may be attached to other image processor to be used therein. In this case, the other image processor may not accurately determine an amount of toner remaining in the used toner cartridge.

In order to resolve the above problem, a radio frequency identification (RFID) tag, which can store various information therein, may be provided to a toner cartridge so that the controller provided in the main body of the image processor may accurately determine an amount of toner remaining in the toner cartridge based on the information stored in the RFID tag. For example, an apparatus serial number, which is rewritable by the controller when necessary, and specific tag information are stored in the RFID tag of the toner cartridge, and the tag information read from the installed toner cartridge and a specific apparatus serial number are recorded in storage provided in the main body. The controller may be configured to determine whether the toner cartridge has been replaced with another one by comparing the tag information and the apparatus serial number stored in the RFID tag with the tag information and the apparatus serial number stored in the storage of the main body, respectively. By doing so, the information of whether the toner cartridge has been replaced may be available to the determination of the amount of toner remaining in the toner cartridge. Thus, it may be possible to accurately determine the amount of toner remaining in the toner cartridge.

SUMMARY OF THE INVENTION

There have been requests for the performance of a consumable product management from various viewpoints. For example, determining the degree to which a predetermined toner cartridge has been used in a predetermined image processor may be useful in development of next-generation products. Therefore, it has been required to develop an apparatus configured to obtain such information. In the known image processor, however, it is impossible to determine an amount of usage of the toner cartridge in the predetermined image processor although the toner stored in the toner cartridge may be effectively used.

The present invention is advantageous in that an image processor capable of an improved consumable product management is provided, and more particularly, an image processor configured to manage the degree to which a consumable product has been used in the image processor is provided.

According to aspects of the invention, there is provided an image processor including a main body and a consumable product which is replaceably installed to the main body. The consumable product is provided with a storage configured to store first identification information intrinsic to the consumable product and life information to be updated in accordance with usage of the consumable product. The main body is provided with a reader configured to read the information from the storage of the consumable product when the consumable product is attached to the main body, a main-body storage configured to store a table to which a record is to be successively added, the record including a first field on which the first identification information is to be recorded, a second field on which initial life information of the consumable product at the time of installation is to be recorded, and a third field on which current life information of the consumable product is to be recorded, an appending unit configured to create a new record containing the first identification information as read from the storage of the consumable product on the first field and the life information as read from the consumable product on the second and third fields, when the reader has read the first identification information and the life information and append the created record to the table, and a rewriting unit configured to rewrite the current life information of the latest record in the table and the life information stored in the storage of the consumable product in accordance with usage of the consumable product.

According to another aspect, there is provided an image processor including a main body and a consumable product which is replaceably installed to the main body. The image processor is provided with a storage configured to store a table to which a record indicative of a usage status of the consumable product is to be successively added, an installation detection unit configured to detect that the consumable product is newly installed, a judging unit configured to judge whether the newly installed consumable product has been used in the main body continuously or discontinuously when the detection unit detects that the consumable product is newly installed, a usage status detection unit configured to detect the usage status of the consumable product, and a controller configured to update the latest record regarding the consumable product based on the usage status detected by the usage status detection unit if the judging unit judges that the consumable product has been continuously used, the controller creating a new record regarding the consumable product to be added to the table if the judging unit judges that the consumable product has been used discontinuously.

According to a further aspect of the invention, there is provided a method of managing a usage status of a consumable product which is replaceably installed to a main body of an image processor. The method includes the step of storing a table to which a record indicative of a usage status of the consumable product is to be successively added, the step of detecting whether the consumable product is newly installed to the main body, the step of judging whether the newly installed consumable product has been used in the main body continuously or discontinuously when the detection unit detects that the consumable product is newly installed, the step of detecting the usage status of the consumable product, the step of updating the latest record regarding the consumable product based on the usage status detected by the detecting step if the judging unit judges that the consumable product has been continuously used and the step of creating a new record regarding the consumable product to be added to the table if the judging unit judges that the consumable product has been used discontinuously.

According to aspects of the invention, usage of a predetermined consumable product in a predetermined image processor can be managed.

Other objects, features, and advantages of the invention will be understood by those skilled in the art from the following detailed description and accompanying drawings.

BRIEF DESCRIPTION OF THE ACCOMPANYING DRAWINGS

Embodiments of the invention will be described in detail with reference to the following figures in which like elements are labeled with like numbers.

FIG. 3A shows information stored in an RFID tag of a fixing unit that has not been used before (i.e., a new fixing unit).

FIG. 3B shows information stored in the RFID tag of the fixing unit that is currently being used in the multifunction device.

FIG. 4A shows information stored in an RFID tag of a developer process unit that has not been used before (i.e., a new developer process unit).

FIG. 4B shows information stored in the RFID tag of the developer process unit that is currently being used in the multifunction device.

FIG. 5A shows information stored in an RFID tag of a toner cartridge that has not been used before (i.e., a new toner cartridge).

FIG. 5B shows information stored in the RFID tag of the toner cartridge that has been just installed in the multifunction device.

FIG. 5C shows information stored in the RFID tag of the toner cartridge that is empty of toner in the multifunction device.

FIG. 5D shows information stored in an RFID tag of a used toner cartridge that has been used in other multifunction device.

FIG. 5E shows information stored in the RFID tag of the used toner cartridge that has been just installed in the multifunction device as a replacement.

FIG. 5F shows information stored in the RFID tag of the used toner cartridge after a predetermined amount of toner in the used toner cartridge has been used in the multifunction device.

FIG. 5G shows information stored in the RFID tag of the used toner cartridge that is installed in the multifunction device again after used in still other multifunction machine.

FIG. 6A shows a consumable product management table stored in a nonvolatile memory, wherein the table shows records including various information obtained from the RFID tags of the new fixing unit of FIG. 3A, the new developer process unit of FIG. 4A, and the new toner cartridge of FIG. 5A.

FIG. 6B shows the consumable product management table stored in the nonvolatile memory, wherein the table shows updates in the records from data in the records of FIG. 6A after the fixing unit, the developer process unit, and the toner cartridge were used to print a predetermined number of sheets.

FIG. 6C shows the consumable product management table stored in the nonvolatile memory, wherein a new record is appended in the table because the toner cartridge that is empty of toner has been replaced with a used toner cartridge.

FIG. 6D shows the consumable product management table stored in the nonvolatile memory, wherein the table shows updates in the records from data in the records of FIG. 6C after the fixing unit, the developer process unit, and the toner cartridge were used to print a predetermined number of sheets.

FIG. 7A shows the consumable product management table stored in the nonvolatile memory, wherein a new record is appended in the table because the used toner cartridge is installed in the multifunction device again after used in still other multifunction device.

FIG. 7B shows the consumable product management table stored in the nonvolatile memory, wherein the table shows updates in the records from data in the records of FIG. 7A after the fixing unit, the developer process unit, and the toner cartridge were used to print a predetermined number of sheets.

FIG. 11 illustrates a consumable product management table according to another embodiment of the invention.

DETAILED DESCRIPTION OF THE EMBODIMENT

Embodiments of the invention are described with reference to the accompanying drawings.

Figure 1:
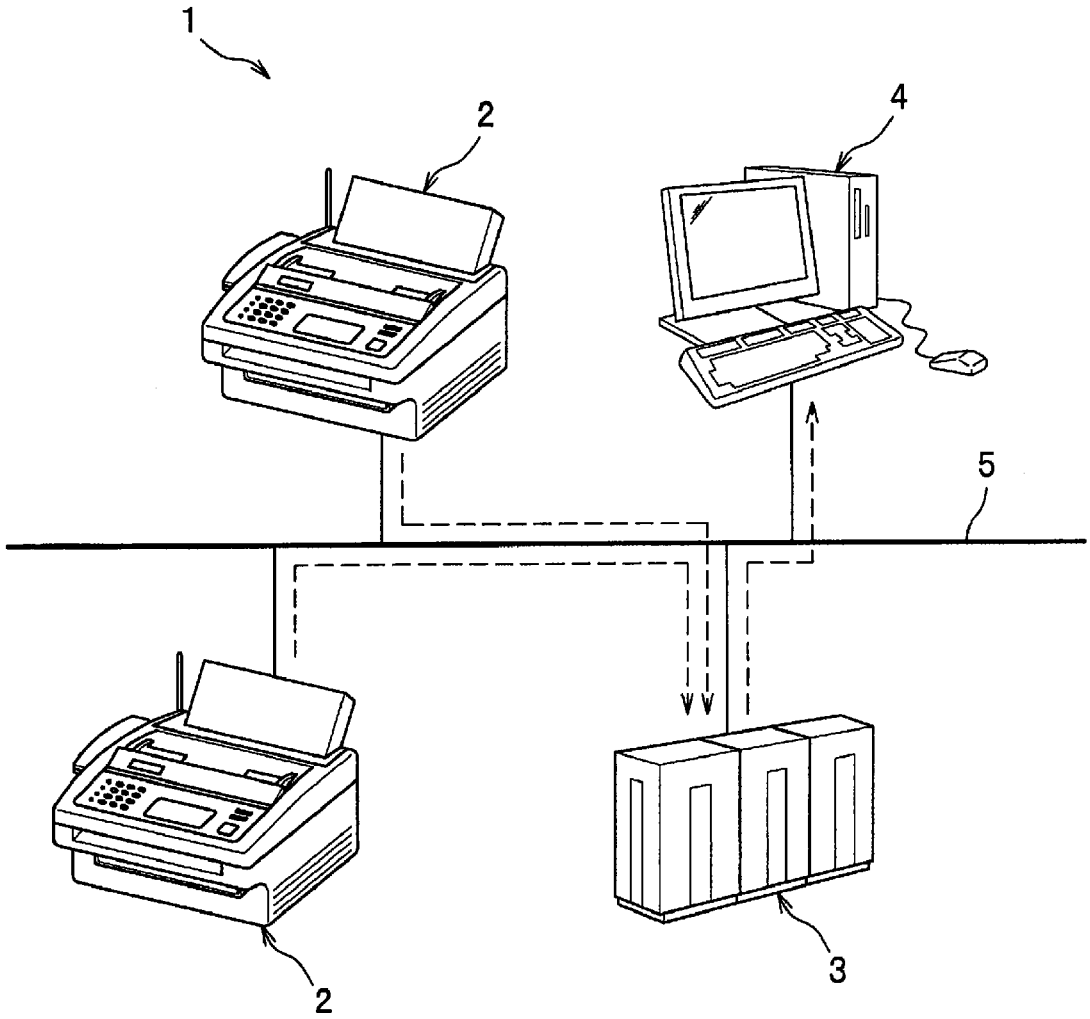
FIG. 1 illustrates an image processing system according to an embodiment of the invention.

As shown in FIG. 1, an image processing system 1 includes a plurality of, e.g., two, multifunction devices 2 (an example of an image processor), a mail server 3, and a management computer 4, which are communicably connected with each other via a local area network (LAN) 5. Various information, such as an amount of remaining toner, may be transmitted directly or via the mail server 3, to the management computer 4 from each of the multifunction devices 2.

Figure 2:
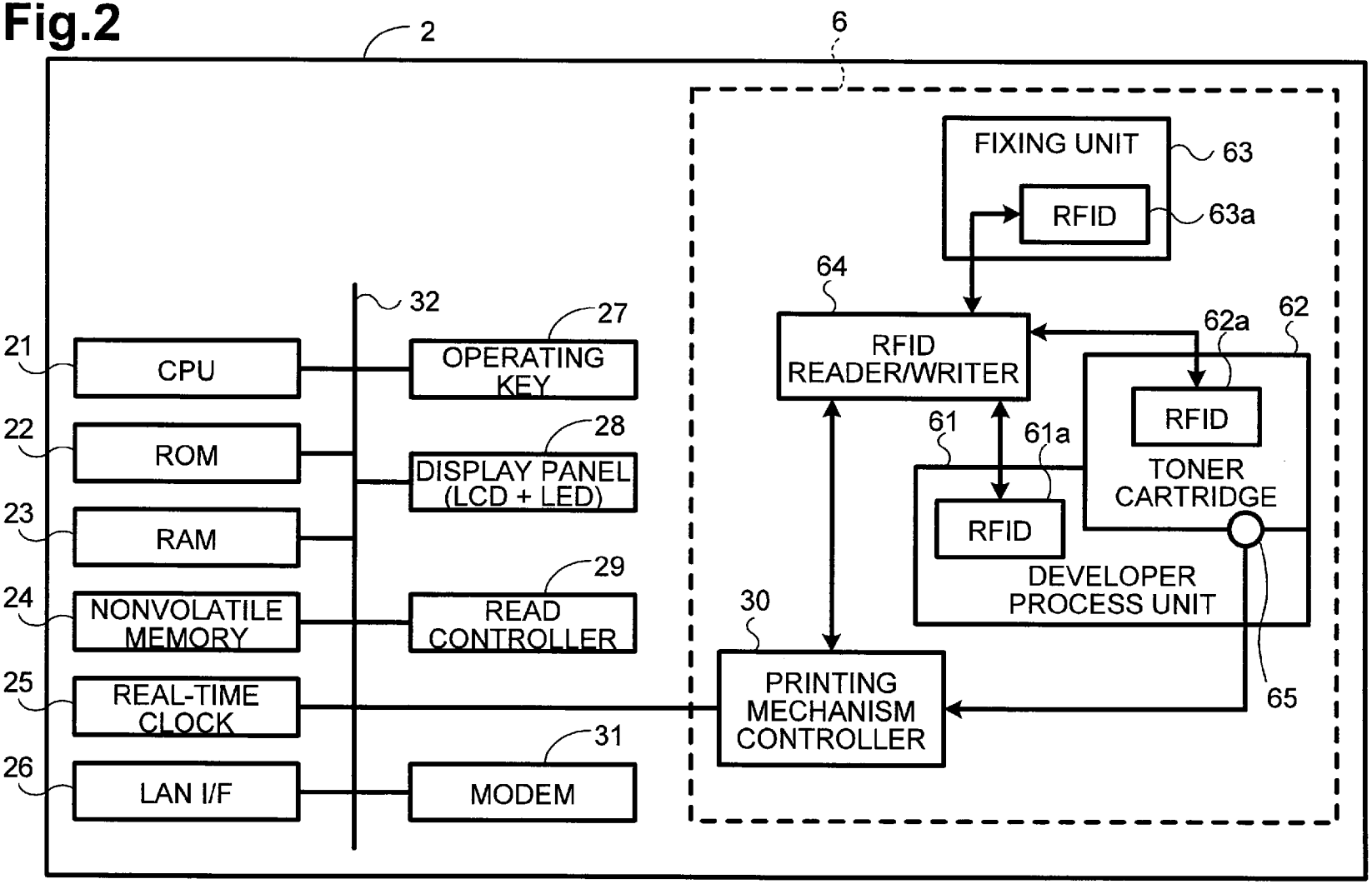
FIG. 2 is a block diagram showing a configuration of a multifunction device.

As shown in FIG. 2, each of the multifunction devices 2 includes a CPU 21, a ROM 22, a RAM 23, a nonvolatile memory 24, a real-time clock 25, a LAN interface (I/F) 26, an operating key 27, a display panel 28, a read control unit 29, a printing mechanism controller 30, a modem 31, which are interconnected through a bus 32, and a printing mechanism 6.

The CPU 21 is configured to control various elements and units shown in FIG. 1 based on a plurality of programs stored in the ROM 22. More specifically, the CPU 21 is configured to successively append a record, e.g. life information of a toner cartridge 62, in the nonvolatile memory 24 when a predetermined condition is satisfied. The CPU 21 is further configured to rewrite the life information stored in the nonvolatile memory 24 and RFID tags 61*a*, 62*a*, 63*a* based on the degree to which the toner cartridge 62 has been used, i.e., an amount of usage of the toner cartridge 62, and rewrite device IDs stored in the RFID tags 61*a*, 62*a*, 63*a*, when a predetermined condition is satisfied. The CPU 21 is further configured to prohibit and allow the appendance of a record, such as the life information, in the nonvolatile memory 24.

The ROM 22 is a read-only memory configured to store a plurality of programs to be used to perform various processing described later.

The RAM 23 is a random access memory. The nonvolatile memory 24 is a semiconductor memory configured to maintain data stored therein even if power is not supplied to the multifunction device 2. The nonvolatile memory 24 is configured to store a consumable product management table (see FIGS. 6A to 6D) and a device ID corresponding to second identification information specific to the main body.

The real-time clock 25 is configured to keeps track of the current time.

The LAN I/F 26 is connected to the LAN 5 and is configured to send and receive information via the LAN 5.

The operating key 27 is used to change the setting of the multifunction device 2 when necessary. The display panel 28 includes a liquid crystal display (LCD) and a light emitting diode (LED) and is configured to display thereon information necessary for the setting of the multifunction device 2.

The read control unit 29 is configured to control operations of a known reading mechanism (not shown) configured to read a document.

The printing mechanism controller 30 is configured to control operations of the printing mechanism 6. Specifically, the printing mechanism controller 30 is configured to determine an amount of usage of each consumable product, for example, a developer process unit 61, the toner cartridge 62, and a fixing unit 63, in accordance with the number of sheets that have been printed which is obtained based on the number of dots in each image formed on each sheet and the number of rotation of a conveyor roller, and output the obtained amount of usage of each consumable product to the CPU 21.

The modem 31 is configured to convert digital data into voice data and send the voice data to a telephone line. The modem 31 is further configured to receive voice data from the telephone line and covert the received voice data into digital data.

The printing mechanism 6 includes a photosensitive drum, a transfer roller, the developer process unit 61 including a charger, the toner cartridge 62, and the fixing unit 63. The photosensitive drum is configured to form an image onto a sheet. The toner cartridge 62 is configured to supply toner into the developer process unit 61. The fixing unit 63 is configured to fix toner transferred onto the sheet by the developer process unit 61 by heat. The RFID tags 61*a*, 62*a*, 63*a* are provided to the developer process unit 61, the toner cartridge 62, and the fixing unit 63, respectively, so as to store their respective information, such as the life information.

The printing mechanism 6 includes an RFID reader/writer 64 configured to read information stored in the RFID tags 61*a*, 62*a*, 63*a* and write information into the RFID tags 61*a*, 62*a*, 63*a*. The RFID reader/writer 64 is connected to the printing mechanism controller 30 and is configured to send the information stored in the RFID tags 61*a*, 62*a*, 63*a* to the printing mechanism controller 30 and also send the information provided from the printing mechanism controller 30 to the RFID tags 61*a*, 62*a*, 63*a*. More specifically, the RFID reader/writer 64 is configured to read the information stored in the RFID tags 61*a*, 62*a*, 63*a* when the developer process unit 61, the toner cartridge 62, and the fixing unit 63 are attached to the main body of the multifunction device 1. The determination whether the consumable product is attached to the main body of the multifunction device 1 may be performed based on a signal to be issued from a sensor that is configured to detect the closing of a front cover of the multifunctional device 1, for example.

A detector mechanism 65 is provided so as to be located in the vicinity of the attached toner cartridge 62 and is configured to detect the amount of toner remaining in the toner cartridge 62. The detector mechanism 65 is connected to the printing mechanism controller 30 and is configured to output information indicating the amount of remaining toner to the printing mechanism controller 30. The printing mechanism controller 30 is configured to perform a known control such that, for example, information of toner empty is displayed on the display panel 28 based on the information indicating the amount of remaining toner.

Next, various information to be stored in the RFID tags 61*a*, 62*a*, 63*a* and the nonvolatile memory are described.

As shown in FIG. 3A, various information are prestored in an RFID tag 63*a* of a new fixing unit 63, which has never been installed in any multifunction devices 2 and has never been used before. Hereinafter, any new consumable products refer to products that have never been installed in any multifunction devices 2 and has never been used before. The prestored information includes, for example, "FU10098765" as first identification information specific to a fixing unit (ID), "100%" as life information (Life), and "FU-180" as a product name (Name). Update information (Updated) and second identification information specific to the multifunction device 2 (Device ID) are blank in the RFID tag 63*a* of the new fixing unit 63.

As shown in FIG. 4A, various information are prestored in an RFID tag 61*a* of a new developer process unit 61. The prestored information includes, for example, "PU10011111" as first identification information specific to a developer process unit (ID), "100%" as life information (Life), and "PU-500" as a product name (Name). Update information (Updated) and second identification information specific to the multifunction device 2 (Device ID) are blank in the RFID tag 61*a* of the new developer process unit 61.

As shown in FIG. 5A, various information are prestored in an RFID tag 62*a* of a new toner cartridge 62. The presorted information includes, for example, "TN10012345" as first identification information specific to a toner cartridge (ID), "100%" as life information (Life), and "TN-550" as a product name (Name). Update information (Updated) and second identification information specific to the multifunction device 2 (Device ID) are blank in the RFID tag 62*a* of the new toner cartridge 62.

When the new fixing unit 63, the new developer process unit 61, and the new toner cartridge 62 are attached to the printing mechanism 6, the information stored in the respective RFID tags 63*a*, 61*a*, 62*a* are read by the RFID reader/writer 64. Then, the CPU 21 records the read information in the consumable product management table stored in the nonvolatile memory 24, as a first record R1, a second record R2, and a third record R3, when the reading of the information by the RFID reader/writer 64 is completed, as shown in FIG. 6A.

The consumable product management table includes a first identification information field (ID) F1, an initial life information field (Initial Life) F2, a current life information field (Current Life) F3, a total printed pages field (Print Pages) F4, an installed date field (Registered) F5, and an update information field (Updated) F6. The information of the first, second and third records R1, R2, R3 are recorded in appropriate fields in the consumable product management table. First identification information specific to each consumable product is recoded in the first identification information field F1. Life information of each consumable product at the time of installation is recorded in the initial life information field F2. Current life information of each consumable product is recorded in the current life information field F3. The number of sheets that have been printed is recorded in the total printed pages field F4. A date when each consumable product is installed is recorded in the installed date field F5. A date when a last update was performed on the current life information is stored in the update information field F6. As shown in FIG. 6A, the date is indicated by year, month and day in the update information field F6. An update time (e.g., hour, minute, and second) may be recorded in the update information field F6 in addition to the date indication.

The CPU 21 is configured to determine the current life information and the number of sheets that have been printed in each consumable product by calculation based on various information obtained from the printing mechanism controller 30 in accordance with the operation of the printing mechanism 6 and write over the existing values with the calculated values in the current life information field F3 and the total printed pages field F4, as shown in FIG. 6B. The CPU 21 is also configured to record a last update in the update information field F6 when the existing record (e.g. the first record R1) is updated. The recording (changing) of the last update in the update information field F6 may be performed when the data of the current life information field F3 or the data of the total printed pages field F4 is updated.

The CPU 21 is further configured to write over the data in the life information and the update information stored in each of the RFID tags 61*a*, 62*a*, 63*a* when the data in the current life information field F3 and the update information field F6 in each of the first, second, and third records R1, R2, R3 of the consumable product management table is updated, as shown in FIGS. 3B, 4B and 5C, in a similar manner to the update of the data in the first, second, and third records R1, R2, R3. The data shown in FIGS. 3B, 4B and 5C are data when the total number of sheets that have been printed reaches 10000 (see FIG. 6B). The CPU 21 is configured to compare the device ID stored in each of the RFID tags 61*a*, 62*a*, 63*a* of each consumable product with the device ID stored in the nonvolatile memory 24 (e.g. an EEPROM). When the both device IDs do not match with each other, the CPU 21 writes over the existing device ID stored in each of the RFID tags 61*a*, 62*a*, 63*a* with the device ID stored in the EEPROM 24.

Next, various processing to be performed by the CPU 21 are described. The descriptions are made, taking a toner cartridge 62 as an example, because the same processing will be performed on other consumable products (e.g., a developer process unit 61 and a fixing unit 63). Thus, the descriptions for the other consumable products will be omitted.

Figure 8A:
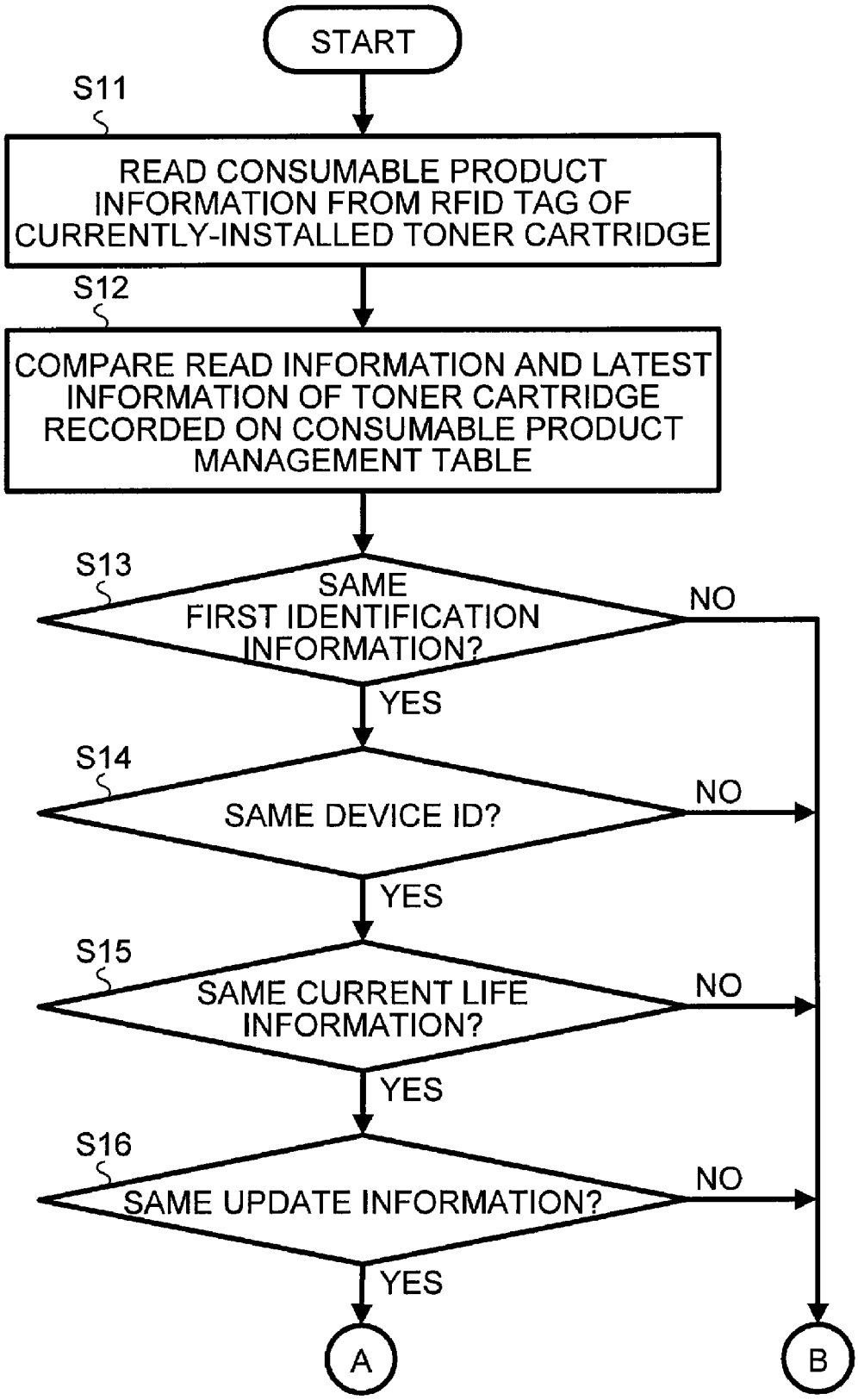
FIG. 8A is a flowchart of record appending processing.
Figure 8B:
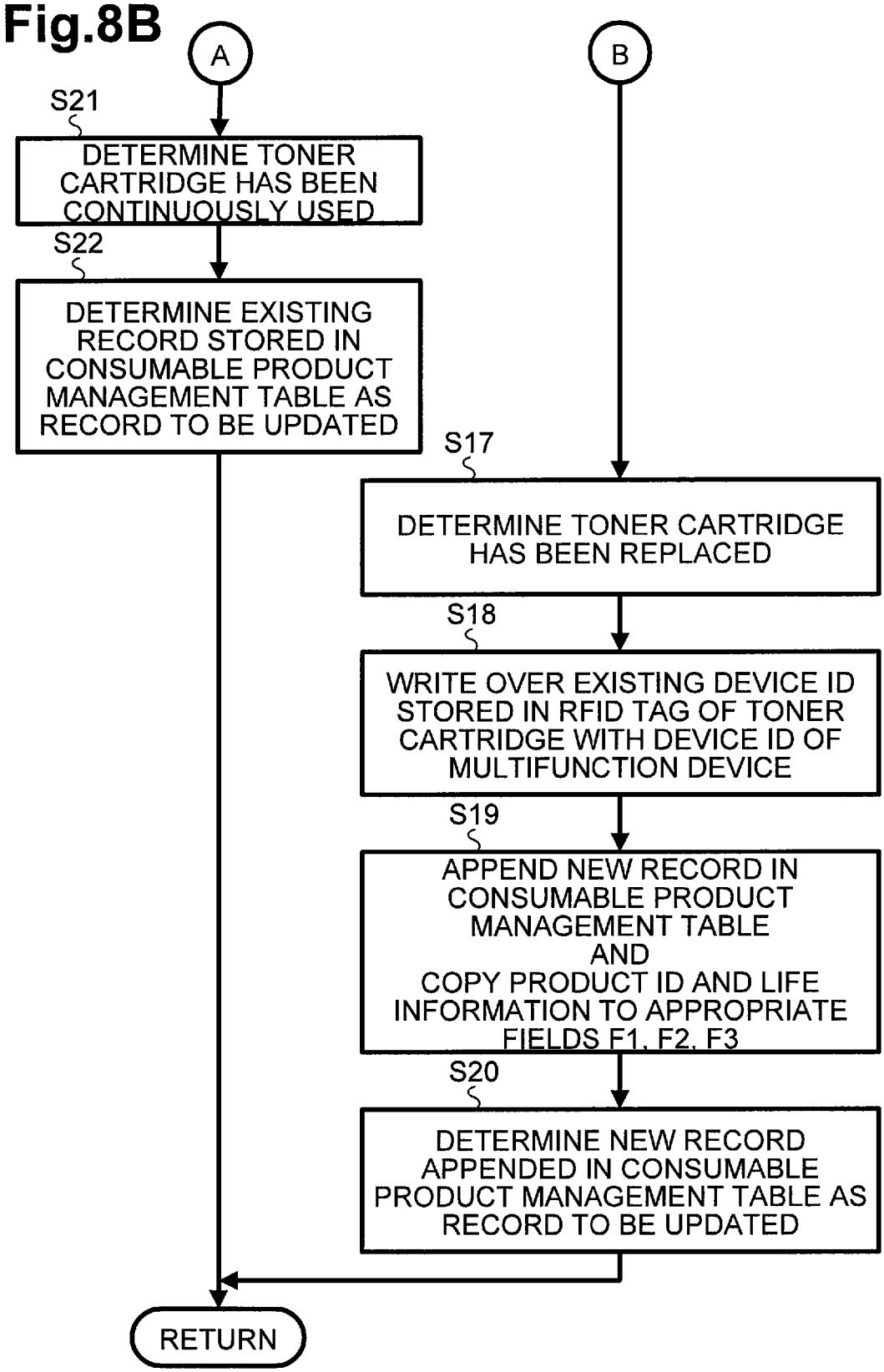
FIG. 8B is a continuation of FIG. 8A.

Referring to FIGS. 8A and 8B, record appending processing is described. First, the CPU 21 reads consumable product information from an RFID tag 62*a* of a currently-installed toner cartridge 62 via the RFID reader/writer 64 when a possibility that the currently-installed toner cartridge 62 is a replacement is detected (step 11, hereinafter, S stands for a step). The case when the possibility of the replacement of the toner cartridge 62 is detected may include, for example, a case when a predetermined signal is received from a sensor configured to detect the attachment and detachment of a toner cartridge 62 or a case when a predetermined signal is received from a sensor configured to detect opening and closing of the front cover that is to be open and closed to attach or detach a toner cartridge 62 to or from the printing mechanism 6.

After S11, the CPU 21 compares the read consumable product information and the latest information of the toner cartridge 62 recorded on the consumable product management table (S12). More specifically, first, the CPU 21 determines whether the both information include the same first identification information (Product ID) (S13). When the CPU 21 determines that the both information include the same first identification information (S13: YES), the CPU 21 determines whether the both information include the same device ID, that is, whether the device ID stored in the RFID 62*a* of the toner cartridge 62 matches with the device ID of the multifunction device 2 (S14).

When the CPU 21 determines that the both information include the same device ID (S14: YES), the CPU 21 determines whether the both information include the same current life information (CuttentLife) (S15). When the CPU 21 determines that the both information include the same current life information (S15: YES), the CPU 21 determines whether the both information include the same update information (Updated) (S16). By performing the processing of S16, it may be possible to determine whether the consumable product, for example, the toner cartridge 62 has been replaced with another one because of the change in the update information even if the current life information has not been changed because, for example, few number of sheets were printed.

When the CPU 21 makes a negative determination at any of the processing of S13 to S16 (S13: NO, S14: NO, S15: NO, S16: NO), the CPU 21 determines that the currently-installed toner cartridge 62 has been replaced (S17). Then, the CPU 21 writes over the existing device ID stored in the RFID tag 62*a* of the toner cartridge 62 with the device ID of the multifunction device 2 (S18). After that, the CPU 21 appends a new record in the consumable product management table (S19). In addition, at S19, the CPU 21 copies the first identification information (Product ID) stored in the RFID tag 62*a* of the toner cartridge 62 to the first identification information field F1 in the appended record. At that time, the CPU 21 also copies the life information (Life) stored in the RFID tag 62*a* of the toner cartridge 62 to the initial life information field F2 and the current life information field F3 in the appended record. In addition, the CPU 21 records the installed date obtained from the real-time clock 25 in the installed date field F5 in the appended record. After S19, the CPU 21 determines the new record appended at S19 as a record to be updated (S20). Then, the flow returns to a main flow (not shown).

When the CPU 21 determines that the both information include the same update information (S16: YES), that is, when the both information include the same first identification information, the same device ID, the same current life information, and the same update information, the CPU 21 determines that the currently-installed toner cartridge 62 has been continuously used without being changed with another one (S21). The continuous use of the toner cartridge 62 includes a case where a currently-installed toner cartridge 62 is removed from the printing mechanism 6 once and attached thereto again as it is. That is, the same toner cartridge 62 has been continuously used. After S21, the CPU 21 determines the existing record, which was used for the comparison with the information stored in the RFID tag 62*a* of the toner cartridge 62, as a record to be updated (S22). Then, the flow returns to the main flow.

Figure 9:
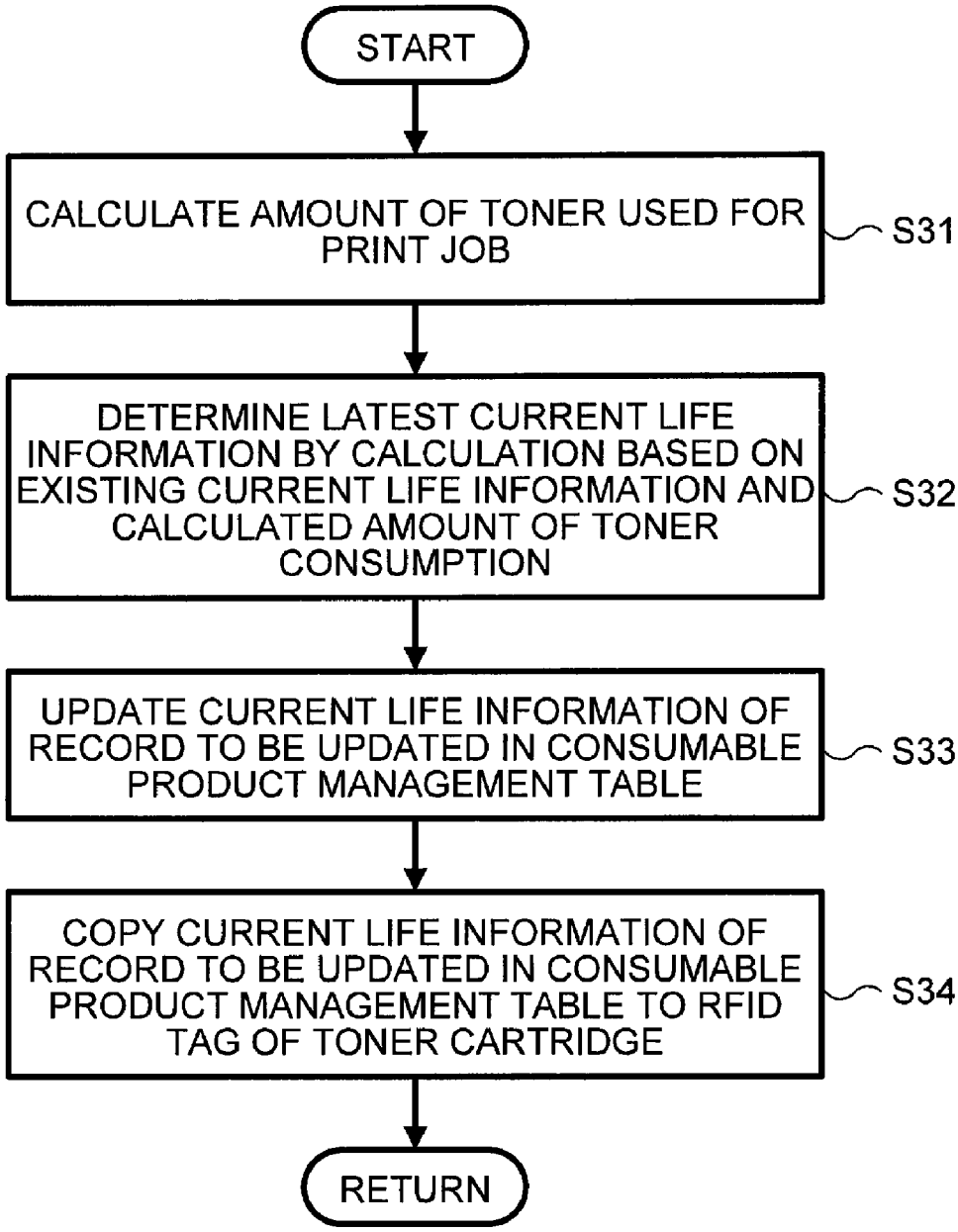
FIG. 9 is a flowchart of current life update processing.

Referring to FIG. 9, current life update processing is described below.

The CPU 21 performs operations in accordance with a flowchart of FIG. 9 every time a print job has been performed. That is, every time a print job has been performed, the CPU 21 calculates an amount of toner used for the print job (S31). The toner consumption calculation processing may be performed in consideration given to a sheet size, a resolution, the number of dots in each image formed on a sheet, and a print density. A known toner consumption calculation processing may be adopted to the processing.

After S31, the CPU 21 determines the latest current life information by calculation based on the calculated amount of toner consumption and the existing current life information of the record to be updated in the consumable product management table (S32) and updates the current life information of the record to be updated (S33). Then, the CPU 21 copies the updated current life information of the record to be updated to the RFID tag 62*a* of the toner cartridge 62 (S34). After that, the flow returns to the main flow.

Hereinafter, specific examples of the operations shown in the flowcharts of FIGS. 8A, 8B and 9 are described.

As described above, similar to the case where the possibility of the replacement of a toner cartridge 62 is detected, for example, when a new toner cartridge 62 is first installed in the printing mechanism 6 of the multifunction device 2, there is no record of information of the toner cartridge 62 in the consumable product management table. Therefore, the CPU 21 performs the processing of S11 to S13 and then makes a negative determination at S13 (S13: NO). After that, the CPU 21 records the device ID of the multifunction device 2 on an RFID tag 62*a* of the toner cartridge 62 (see FIG. 5B). The CPU 21 appends a third record R3 as a record of the toner cartridge 62 as shown in FIG. 6A and copies the information stored in the RFID tag 62*a* to appropriate fields in the third record R3 (see FIG. 5B) at S19.

Then, the CPU 21 determines the appended third record R3 as a record to be updated (S20). After that, the CPU 21 performs the current life update processing shown in FIG. 9 every time a print job has been performed. In the flowchart of FIG. 9, the CPU 21 determines the latest current life information by calculation (S31 and S32). Then, the CPU 21 successively writes over the existing data with the calculated current life information in the third record R3 in FIG. 6A. By doing so, the value of the current life information in the third record R3 gradually decreases from "100%" shown in FIG. 6A and finally reaches "1%" as shown in FIG. 6B. The total printed pages information and the update information are also updated to the latest information when the current life information is updated. The current life information of other consumable products (e.g., the fixing unit 63 and the developer process unit 61) is also updated in a similar manner.

As the current life information reaches "1%", the currently-installed toner cartridge 62 is nearly empty of toner, so that the user replaces the toner cartridge 62 with another toner cartridge 62. For example, when the empty toner cartridge 62 is replaced with another toner cartridge 62 that has been used in another multifunction device 2 and has a product ID and a device ID which are different from those of the empty toner cartridge 62 (i.e. a used toner cartridge 62), the CPU 21 makes a negative determination at S13 (S13: NO) as shown in FIG. 8A. Then, the CPU 21 writes over the existing device ID stored in an RFID tag 62*a* of the used toner cartridge 62 with the device ID of the multifunction device 2 at S18 (see FIGS. 5D and 5E) and appends a new record (e.g. a fourth record R4) in the consumable product management table at S19 as shown in FIG. 6C. At S19, in addition, the CPU 21 copies the information stored in the RFID tag 62*a* of the used toner cartridge 62 (see FIG. 5E) to appropriate fields in the fourth record R4. After that, the CPU 21 determines the appended fourth record R4 as a record to be updated at S20, and successively updates the current life information as shown in FIG. 6D. In response to the update of the fourth record R4, the current information stored in the RFID tag 62*a* of the used toner cartridge 62 is updated as shown in FIG. 5F.

Next, another usage situation of a toner cartridge 62 is described. It is assumed that a currently-installed toner cartridge 62 had been removed from a multifunction device 2 once and is again used therein after the toner cartridge 62 was used in other multifunction device 2 until a predetermined amount of toner in the toner cartridge 62 was used in the other multifunction device 2. For example, a toner cartridge 62 had been removed from a multifunction device 2 once and was used in other multifunction device 2 until its current life information reached "50%" in the other multifunction device 2. Then, the toner cartridge 62 having "50%" of the current life was removed from the other multifunction device 2 and is installed and used in the original multifunction device 2 again (see FIG. 5G). When the toner cartridge 62 is reinstalled in the original multifunction device 2, the CPU 21 makes an affirmative determination at S13 of FIG. 8A and makes a negative determination at S14 of FIG. 8A. After that, the CPU 21 writes over the existing device ID stored in the RFID tag 62*a* with the device ID of the original multifunction device 2 at S18. As shown in FIG. 7A, the CPU 21 appends a new record (e.g. a fifth record R5) in the consumable product management table and copies the information stored in the RFID tag 62*a* of the toner cartridge 62 (see FIG. 5G) to appropriate fields in the fifth record R5. Then, as described above, the CPU 21 determines the appended fifth record R5 as a record to be updated and appropriately updates the current life information as shown in FIG. 7B.

Figure 10:
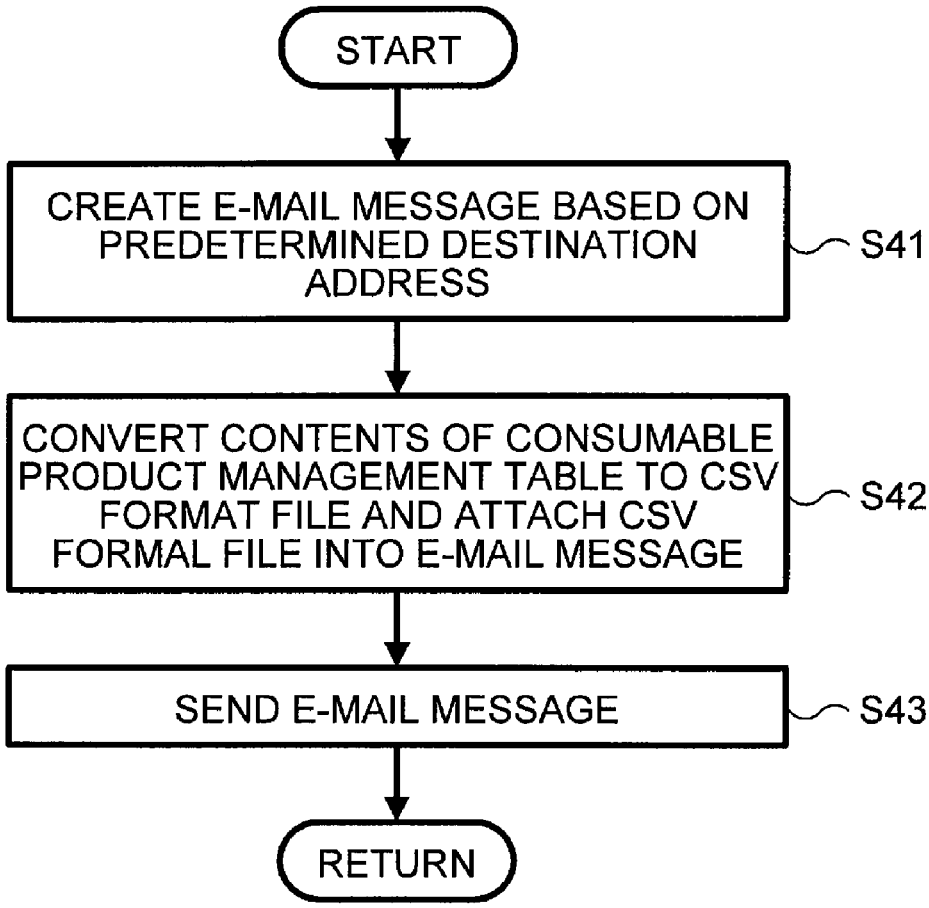
FIG. 10 is a flowchart of consumable product usage information notification processing.

Referring to FIG. 10, consumable product usage information notification processing is described below.

When a predetermined event occurs (e.g., an instant when the current time reaches a mail sending time set by the user, or an instant when the front cover is opened), the CPU 21 performs operations in accordance with a flowchart of FIG. 10. First, the CPU 21 creates an e-mail message based on a predetermined destination address stored in the nonvolatile memory 24 (S41). Then, the CPU 21 converts the contents of the consumable product management table (e.g. a predetermined record) to a CSV (comma separated value) format file and attach the CSV format file into the e-mail message (S42). After that, the CPU 21 sends the e-mail message to the predetermined destination address (S43). Then, flow returns to the main flow.

As illustrated, every time a consumable product is installed in the printing mechanism 6 of the multifunction device 2, the information of the installed consumable product is appended in the consumable product management table as a new record (e.g., the fourth record R4 and the fifth record R5). That is, a past usage record of the consumable product remains as a history in the consumable product management table, so that the usage of a predetermined consumable product in a predetermined multifunction device 2 may be managed.

The CPU 21 is configured to prohibit the creation of a new record when the information stored in an RFID tag of a consumable product and the information stored in the consumable product management table include the same first identification information, the same device ID, the same current life information, and the same update information (S13: YES, S14: YES, S15: YES, S16: YES, S21 and S22). Thus, in a case where a consumable product is removed from a multifunction device 2 once and is attached thereto again as it is, the consumable product may be maintained by using the existing record without a new record being created in the consumable product management table. Accordingly, the creation of wasted records is restricted, so that an increase of the amount of storage data may be minimized.

As described above, the date information is recorded on the records (e.g., the first to fifth records R1 to R5) in the consumable product management table and on the RFID tags 61*a*, 62*a*, 63*a*. Thus, the user may confirm the date when the consumable product was used and the consumable product management may be satisfactorily performed.

The first identification information field (Product ID) is provided in records to be appended, so that the user may confirm the consumable product replacement history. In addition, the total printed pages field is provided in records to be appended, so that the user may confirm a cost of printing per page in each consumable product. Further, the date when the consumable product was replaced with another one is recorded on records to be appended, so that the user may confirm the date when the consumable product was replaced with another one.

While the features herein have been described in connection with various example structures and illustrative aspects, it will be understood by those skilled in the art that other variations and modifications of the structures and aspects described above may be made without departing from the scope of the invention. Other structures and aspects will be apparent to those skilled in the art from a consideration of the specification or practice of the features disclosed herein. It is intended that the specification and the described examples only are illustrative with the true scope of the inventions being defined by the following claims.

As described above, the information, such as the first identification information, the device ID, the current life information and the update information, are compared between the information stored in an RFID of a consumable product and the information stored in the consumable product management table at S13 to S16. When the both information do not include the same information, a new record is appended in the consumable product management table. Alternatively, for example, a new record may be appended every time a consumable product was replaced without performing such comparisons.

The life information is expressed as a percentage (%) in the above-described embodiments. Other units, for example, "g (gram)", "the number of sheets that have been printed", or "the number of sheets that can be printed", may be used to express the life information.

The update of the current life information may be performed after the amount oftoner consumption is accumulated to some extent if the amount of toner consumption is extremely small amount, for example, 1% or 0.1%. In this case, the amount of toner consumption when the update of the life information is postponed is separately stored in another area until the update is performed.

As described above, the information of the record in the consumable product management table is sent to the management computer 4 via an e-mail message. Alternatively, the information of the record may be directly sent to the management computer 4.

The multifunction device 2 is adopted as an example of the image processor. Printers or copying machines may be adopted as an example of the image processor.

As described above, a new record is to be appended in the consumable product management table when a new consumable product is first installed in a multifunction device 2 or when a consumable product has been replaced with another one (S17 and S19 of FIG. 8B). For example, as shown in FIG. 11, a new record (e.g. a fourth record R4) of a toner cartridge (TN10012345) may be appended when a new developer process unit, which is empty of toner, has been filled with a predetermined amount of toner supplied from the toner cartridge. More specifically, a new record may be appended when the value of the current life information (CurrentLife) of the toner cartridge decreases "5%" from "100%". By doing so, an amount of toner consumption in the toner cartridge to fill the empty developer process unit with toner may be controlled separately from the amount of toner consumption for printing. Accordingly, the amount of toner consumption for printing may be precisely obtained.

What is claimed is:

1. An image processor including a main body and a consumable product which is replaceably installed to the main body, the consumable product comprising:

a storage configured to store first identification information intrinsic to the consumable product and life information to be updated in accordance with usage of the consumable product, the main body comprising:

a reader configured to read the information from the storage of the consumable product when the consumable product is attached to the main body;

a main-body storage configured to store a table to which a record is to be successively added, the record including a first field on which the first identification information is to be recorded, a second field on which initial life information of the consumable product at the time of installation is to be recorded, and a third field on which current life information of the consumable product is to be recorded;

a judging unit configured to judge whether the consumable product was used in a device other than the image processor after the consumable product was installed to the main body;

an appending unit configured to create a new record containing the first identification information as read from the storage of the consumable product on the first field and the life information as read from the consumable product on the second and third fields, only when the judging unit judges that the consumable product was used in a device other than the image processor after the consumable product was installed to the main body, and configured to append the created record to the table; and a rewriting unit configured to rewrite the current life information of the latest record in the table and the life information stored in the storage of the consumable product in accordance with usage of the consumable product, only when the judging unit judges that the consumable product was not used in a device other than the image processor after the consumable product was installed to the main body.

2. The image processor according to claim 1, further comprising a comparing unit configured to compare the first identification information and the life information read by the reader with the first identification information and the current life information recorded in the latest record in the table, the comparing unit allowing the appending unit to create the new record when at least one of the first identification information and the life information read by the reader does not match with the first identification information and the current life information recorded in the latest record in the table; and the comparing unit prohibiting the appending unit from creating the new record when both of the first identification information and the life information read by the reader match with the first identification information and the current life information recorded in the latest record in the table.

3. The image processor according to claim 1, wherein the record in the table further includes a fourth field on which update information is recorded, and wherein the rewriting unit is further configured to record a current date on the fourth field of the latest record and the storage of the consumable product as date information when the life information has been updated.

4. The image processor according to claim 3, wherein the storage of the consumable product is further configured to store date information to be updated in accordance with the usage of the consumable product, wherein the comparing unit is further configured to compare the first identification information and the date information read by the reader with the first identification information and the date information in the latest record in the table, the comparing unit allowing the appending unit to create the new a record when at least one of the first identification information and the date information read by the reader does not match with the first identification information and the date information recorded in the latest record in the table, the comparing unit prohibiting the appending unit from creating the new record when both of the first identification information and the date information read by the reader match with the first identification information and the date information recorded in the latest record in the table.

5. The image processor according to claim 1, wherein the storage of the consumable product is further configured to store second identification information intrinsic to the main body to which the consumable product is attached, wherein the main-body storage is further configured to store the second identification information; and wherein the comparing unit is further configured to compare the second identification information read by the reader with the second identification information stored in the main-body storage, the comparing unit storing the second identification information, which is stored in the main-body storage, in the storage of the consumable product when the second identification read by the reader and the second identification information stored in the main-body storage do not match with each other as a result of the comparison, wherein the comparing unit allows the appending unit to create the new record when both of the second identification information do not match with each other as the result of the comparison, while prohibits the appending unit from creating the new record when both of the second identification information match with each other as the result of the comparison.

6. An image processor including a main body and a consumable product which is replaceably installed to the main body, comprising:

a storage configured to store a table to which a record indicative of a usage status of the consumable product is to be successively added;

an installation detection unit configured to detect that the consumable product is newly installed;

a judging unit configured to judge whether the newly installed consumable product has been used in the main body continuously or discontinuously when the detection unit detects that the consumable product is newly installed;

a usage status detection unit configured to detect the usage status of the consumable product; and a controller configured to update the latest record of the table regarding the consumable product based on the usage status detected by the usage status detection unit if the judging unit judges that the consumable product has been continuously used, the controller creating a new record regarding the consumable product to be added to the table if the judging unit judges that the consumable product has been used discontinuously, wherein the judging unit judges that the newly installed consumable product has been used in the main body continuously, only when the newly installed consumable product was not used in a device other than the image processor after the newly installed consumable product was installed to the main body, and wherein the judging unit judges that the newly installed consumable product has been used in the main body discontinuously, only when the newly installed consumable product was used in a device other than the image processor after the newly installed consumable product was installed to the main body.

7. A method of managing a usage status of a consumable product which is replaceably installed to a main body of an image processor, comprising the steps of:

storing a table to which a record indicative of a usage status of the consumable product is to be successively added;

detecting whether the consumable product is newly installed to the main body;

judging whether the newly installed consumable product has been used in the main body continuously or discontinuously when the detection unit detects that the consumable product is newly installed;

detecting the usage status of the consumable product;

updating the latest record of the table regarding the consumable product based on the usage status detected by the detecting step if the judging unit judges that the consumable product has been continuously used; and creating a new record regarding the consumable product to be added to the table if the judging unit judges that the consumable product has been used discontinuously, wherein when the judging step judges that the newly installed consumable product has been used in the main body continuously, only when the newly installed consumable product was not used in a device other than the image processor after the newly installed consumable product was installed to the main body, and wherein when the judging step judges that the newly installed consumable product has been used in the main body discontinuously, only when the newly installed consumable product was used in a device other than the image processor after the newly installed consumable product was installed to the main body.

* * * * *